United States Patent [19]

Jacob

[11] 3,994,209

[45] Nov. 30, 1976

[54] CONTINUOUS HIGH SPEED PLASTIC BAG FABRICATING MACHINE

[75] Inventor: George Jacob, Woodside, N.Y.

[73] Assignee: Fred Peltola, Bayside, N.Y.

[22] Filed: Dec. 12, 1974

[21] Appl. No.: 532,093

[52] U.S. Cl. ..... 93/8 R; 93/DIG. 1; 93/34; 242/66

[51] Int. Cl.[2] ..... B31B 27/14

[58] Field of Search ..... 93/8 R, 33 H, DIG. 1, 93/35 R, 34, 33 R; 242/66, 65; 156/351, 353, 361, 510, 513, 583; 226/42

[56] References Cited

UNITED STATES PATENTS

| | | | |
|---|---|---|---|
| 2,999,532 | 9/1961 | Bursak | 156/583 X |
| 3,205,117 | 9/1965 | Osborn, Jr. | 156/513 |
| 3,286,005 | 11/1966 | Cook | 93/34 UX |
| 3,286,944 | 11/1966 | Kusel | 242/66 |
| 3,539,085 | 11/1970 | Anderson et al. | 226/42 X |
| 3,552,278 | 1/1971 | Guenther | 93/8 R |
| 3,743,567 | 7/1973 | Abler | 93/8 R X |

*Primary Examiner*—James F. Coan
*Attorney, Agent, or Firm*—Allison C. Collard

[57] ABSTRACT

A method and apparatus for the continuous manufacture of plastic bags from an extruder which includes a differential tachometer which senses the speed of the film in two locations so that the film drive can be adjusted to compensate for the shrinkage of the film and to eliminate tension in the film. Welding and perforating blades are provided which contact the travelling film and travel with the film to complete their weld and perforations before returning to their initial positions. One type of welding and perforating device uses a pair of opposed blocks which come together around the film and travel with the film while the perforating blade pierces through the film and the weld is being completed. A timing cam coupled to the film drive determines the spacing of the welds and perforations and thus the length of each bag produced. A separating device is also included so that if the bags are perforated and include a cut line along their perforations, a pair of faster moving rollers can be engaged to the moving film to pull the perforations apart and separate the bags.

16 Claims, 14 Drawing Figures

CONTINUOUS HIGH SPEED PLASTIC BAG FABRICATING MACHINE

This invention relates to an apparatus to the continuous high speed manufacture of plastic bags.

More specifically, this invention relates to a machine for continuously manufacturing plastic bags of different shapes without interruption.

conventional machines which manufacture plastic bags generally utilize large cylinders of rolled up flat tubular plastic film. The film is generally moved along a flat surface until the leading edge of the plastic is located at a fixed distance beyond the welding blade. This distance is preset to the desired length of the bag so that an electrically heated blade can be brought down on the tubular plastic web in order to weld or heat seal two flat sides together. Several bag lengths from the welding blade is generally disposed cutting blade which will cut the bag below the welded edge to form a single bag. This is a rather slow and intermittant process to produce the bags, and has the disadvantage that the machine has to start and stop in short intervals of speed. Moreover, the production of a conventional type of machine is rather limited due to the intermittant manufacturing steps.

Accordingly, the present invention provides a machine for producing plastic bags continuously and at high speeds without alternately starting the stopping the apparatus. The machine is preferably connected to the plastic extruder so that the bags can be formed at the output of the apparatus as fast as the blown film is produced by the extruder. This eliminates the costly handling steps of having to replace cylinders of plastic tubular film at the input of the machine. The apparatus according to the invention can also take a single wide roll of plastic film and form bags or several narrower rolls of plastic film so that a plurality of bags can be produced side-by-side.

In the operation of the apparatus according to the invention, after the plastic film leaves the extruder, it can be fed into a continuous printing apparatus which can print an advertising message on one or both sides. The film then enters the welding and cutting section of the apparatus which is performed in a smooth and continuous manner resulting in a considerable savings. The speed of the machine can be accurately adjusted from very slow to high speeds and could be regulated to the speed of the film extruder. If only a roll of plastic film were to be fed into the machine, then the machine could be run at very high speeds to produce a much larger number of bags in a given time. With the extruder, printing machine and the plastic bag manufacturing machine of the present invention all working together, the speed of the entire operation has to be synchronized. All units are thus coupled together to run at the same speed so the production of the system would depend on the speed of the slowest unit in the operation.

The machine of the present invention also includes a compensating device which detects shrinkage and tension in the material, and will regulate the operating speed of the machine in accordance with the amount of shrinkage and tension. This present invention apparatus measures the film in two different locations after the film has finished shrinking, and all the tensions have been relaxed. The difference between these two speeds is used by a differential tachometer to adjust the speed of the remaining portion of the machine so that the film will always move through the machine free of any tension.

A timing device is used to determine the length of bag to be produced. The device is synchronized with the speed of the machine so that the bags will always be cut to the same preset length independent of the speed of the machine. The timing device is adjustable so that the bag length can be easily changed.

The machine also has the capability of producing individual bags, strings of bags (of a preset number) or a large series of bags wound onto a roll. The perforating blade of the machine partially cuts through the separation between the bags so that at the output, a set of rollers can be provided which will pull the bags apart if individual bags are required, or maintain the bags in a continuous chain if they are to be put onto rolls. This invention has a counting device which could be set to command the "pull-apart" rollers to separate strings of bags of preset numbers or each bag one by one. Another counting device can stop the machine after a preset number of single bags or strings of bags have been produced.

It is therefore an object according to the present invention to provide a continuous high speed plastic bag fabricating machine which is capable of heat sealing, perforating and separating plastic bags from a plastic film in a continuous manner. The plastic film can be either flat tubular film or flat folded film. When flat folded film is used, a perforating blade is mounted between two welding blades so that two welds and a perforation line between are formed at the same time. The two welds form the sides of adjacent bags and the folded part becomes the bottom of the bag.

It is another object according to the present invention to provide a continuous high speed plastic bag fabricating machine which is simple in design, easy to construct and reliable in operation.

Other objects and features of the present invention will become apparent from the following detailed description considered in connection with the accompanying drawings which disclose the embodiments of the invention. It is to be understood however that the drawings are designed for the purpose of illustration only and not as a definition of the limits of the invention.

In the drawings wherein similar reference characters denote similar elements throughout the several views.

Figure 1:
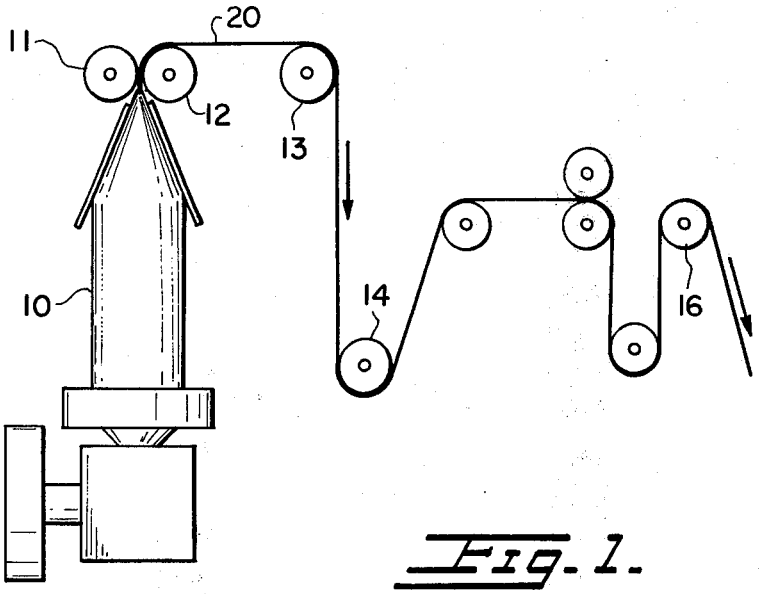
FIG. 1 is a partial schematic drawing of a blown film extruder which produces a hollow plastic film.

Referring to FIG. 1 there is shown a partial schematic diagram of a blown film extruder 10 similar to that disclosed in U.S. Pat. No. 3,743,567. The output of the extruder is a flat tubular plastic film 20 which passes through driven rollers 11 and 12 over either rollers 13 and 14 to finally pass through input roller 16 so that the web of plastic can be fed to the next unit of the machine. The speed of the rollers 11, 12, 13 and 16 are synchronized with the rest of the units of the machine.

Figure 2:
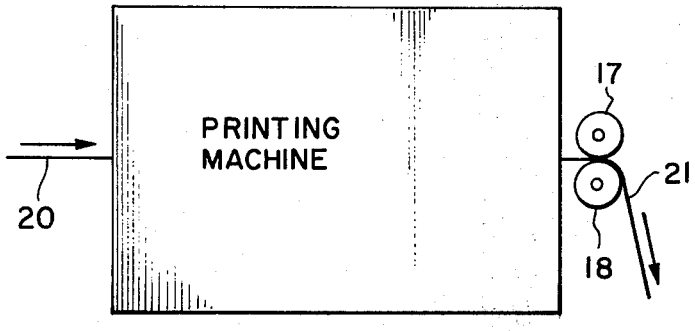
FIG. 2 is a schematic of a printing machine for receiving the plastic film and capable of printing on both sides thereof.

FIG. 2 discloses a printing machine in schematic form which accepts at its input, plastic web 20 so that the web can be printed on one or both sides with an advertising message before being coupled through its output by rollers 17 and 18. The printed web is identified as film 21. Rollers 17 and 18 will be synchronized with output roller 16.

Figure 3:
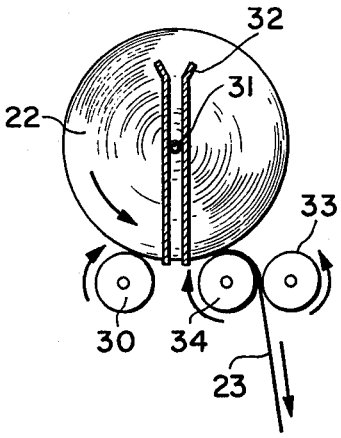
FIG. 3 is a roll of blown plastic film supported on a bearing capable of movement in a vertical slide for delivery of a film web to the apparatus of the invention.

FIG. 3 discloses a means of supplying the invention with a full roll of flat tubular plastic film mounted on an axis 31 which is capable of vertical movement within vertical slides 32. Disposed at the bottom of plastic roll 22 are a pair of driven rollers 30 and 34 with equal diameters and fixed locations. Both rotate at the same speed and in the same direction as shown in order to feed the machine with material 23. The full width of the roll rests on both rollers 30 and 34 so that the complete weight of the roll is uniformly distributed along the length of both rollers. This produces a frictional force between the plastic film and the rollers when the rollers are driven so that the material 23 will advance and peel off as shown. The diameter of roll 22 will then be reduced as the material is removed but the roll will always rest on both driven rollers and will be forced to turn or stop when both rollers do the same. The speed of the film will be constant and have the same tangental speed as rollers 30 and 34. Since the weight of material roll 22 is supported by both rollers, only a small frictional force will be created so that the film will be able to advance without any additional tension. Roller 33 presses against roller 34 and is driven counterclockwise as the material passes between it and roller 34. Roller 33 helps both layers of the film to advance together without any relative slippage. Rollers 30, 34 and 33 can be constructed of metal and provided with a roughened surface or knurled, or covered by a plastic or rubber material to reduce surface slippage.

Figure 4:
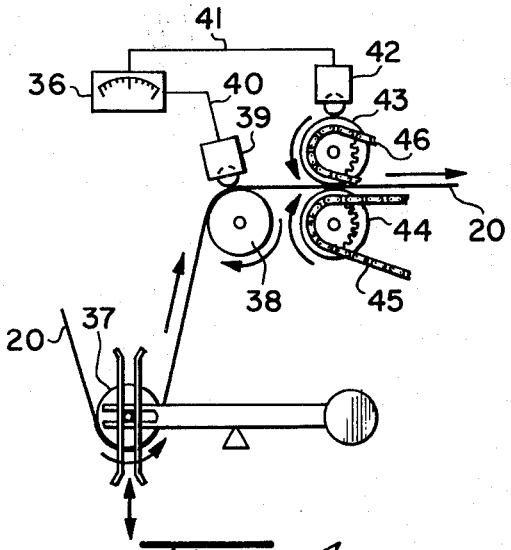
FIG. 4 is a differential speed tachometer for adjusting the speed of the machine after shrinkage and tension.

If the plastic film is to be fed into the subsequent units of the apparatus of the invention either directly from the extruder, printing machine or from roll of FIG. 3, there may be some tension in the film due to the heat of the extrusion or the printing machine, but there would be a considerable amount of tension in the roll of FIG. 3. The film can shrink as much as 10percent before it is ready for welding and perforating. In FIG. 4, there is shown a differential tachometer whereby film 20, 21 or 23 is fed around a counterbalanced roller 37 which is free to rotate with the movement of the material and can move up and down in a vertical direction in response to the tension or variation in the shrinkage of the material. The film is then fed over the surface of roller 38 which is free to rotate in its fixed location and contacted by a first microgenerator wheel 39 which is connected through line 40 to tachometer 36. The film is then fed between driven rollers 43 and 44 which are driven by chains 45 and 46 connected to respective sprocket wheels at the ends of the rollers. In contact with the surface of rollers 43 is a second microgenerator wheel 42 which is connected through electrical line 41 to another terminal of tachometer 36. Cylinders 43 and 44 are the same diameter and are driven at the same speed as the film and are pressed together along the same axis.

The speed at which the film passes through the machine is dependent upon the type of material being run, its thickness and the length of bags being produced. The speed also depends upon the operating speed of the extruder or the printing machine when the apparatus is directly connected to them. The machine could also operate at higher speeds when a rolled up film 22 such as that shown in FIG. 3 is connected to the machine. The differential tachometer 36 is adjusted to the average operating speed for each case and the range between the minimum and maximum settings of the tachometer will be in accordance with the range of shrinkage of the film. When the speed of the film exceeds either the upper or lower limit settings of the tachometer, the speed of rollers 43 and 44 will be increased or decreased accordingly, and will maintain the film in a relaxed state without tension. The tachometer is connected to the main drive motor of the apparatus in order to regulate its speed in accordance with the shrinkage and tension in the film. All of the rollers of FIG. 4 may be similar to the rollers described with respect to FIG. 3 in having non-slip surfaces.

Figure 5:
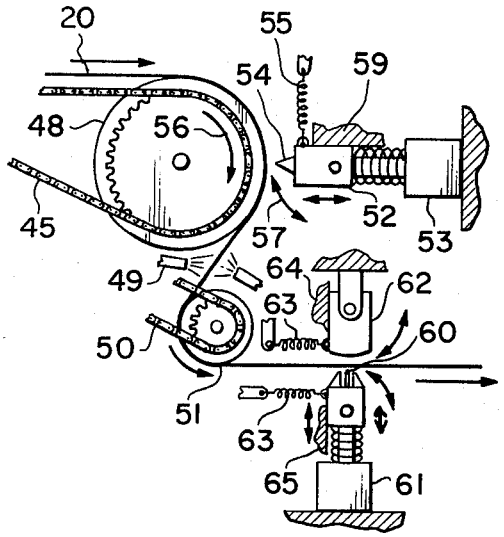
FIG. 5 is a partial schematic view showing one embodiment welding and perforating portion of the machine.
Figure 6:
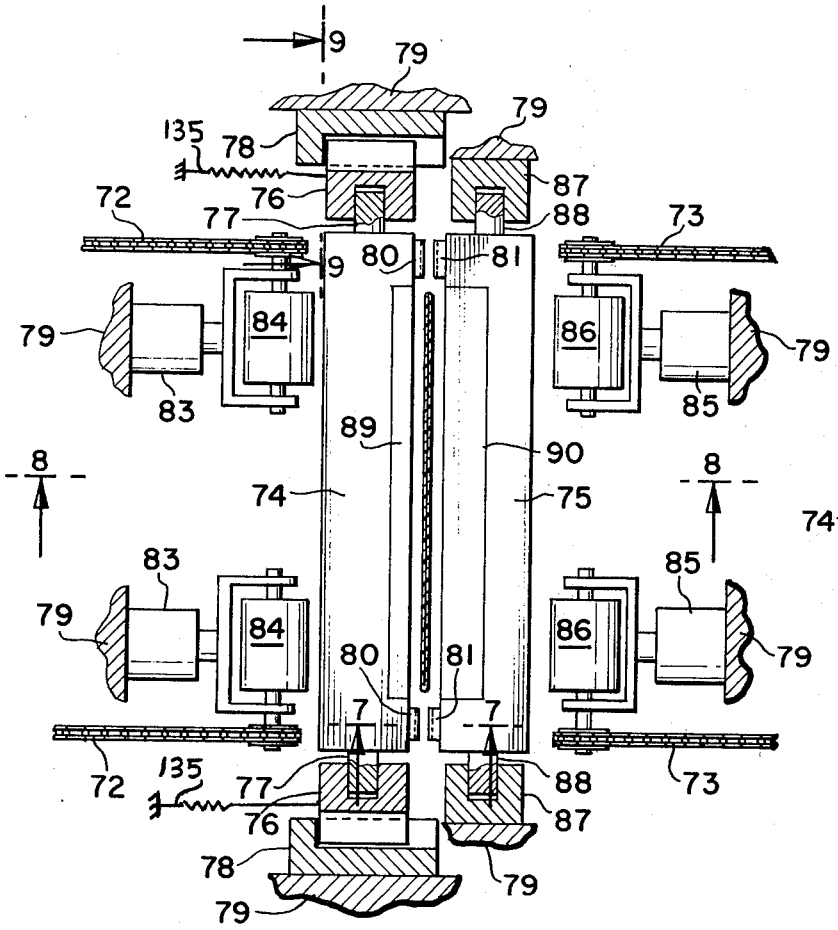
FIG. 6 is a top view of another embodiment of a welding and perforating unit in the machine.
Figure 7:
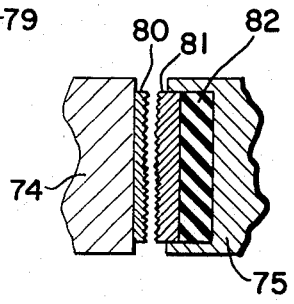
FIG. 7 is a cross sectional view taken through Section 7—7 of FIG. 6.
Figure 8:
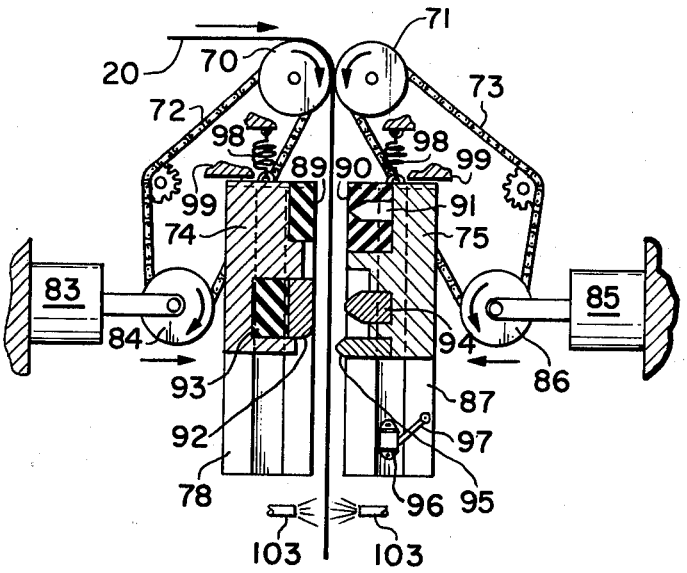
FIG. 8 is a cross sectional view taken through Section 8—8 of FIG. 6.

FIG. 5 shows one embodiment of a perforating and welding unit wherein film 20 is fed to a driven roller 48 which is driven by chain drive 45 connected to a sprocket at the end of the roller. Roller 48 is driven at the same tangential speed as roller 44. The peripheral speed of rollers 44 and 48 will be the same and always adjusted by differential tachometer 36. The web is then passed between cooling blowers 49 into driven roller 51 which is driven by chain 50.

Directed against the surface of roller 48 is a welding assembly 52 which can be propelled by solenoid 53 when an electrical signal is applied to it. When welder 54 strikes web 20 on the surface of drum 48, it will move downward as shown by arrows 57, following web 20 until the weld has been completed. Welder 54 will then be retracted from the web by the solenoid spring. Spring 55 will return the welding assembly 52 back to its horizontal normal position against stop 59. Drum 48 preferably has a resilient surface (teflon coated) so that it will accept the edge of welder 54 after it engages the plastic tubular web 20. The welded film, after being cooled by blowers 49, is then fed by driven cylinder 51 to a perforating assembly.

A perforating blade 60 is mounted on the end of a further solenoid 61 for contact with the surface of film 20 and block 62. An electrical signal applied to solenoid 61 will cause perforating blade 60 to contact moving web 20 and push it against resilient block 62 so as to form a line of transverse perforations across the moving web. Springs 63 will permit both the perforator and the block to move in the direction of the film as the perforation is completed. After the perforating blade is retracted, the perforating assembly and the block will return to its original position against stops 64 and 65.

The embodiments of FIGS. 6—9 disclose an alternative unit for welding and perforating the bag over the unit shown and described with respect to FIG. 5.

Plastic film 20 fed from rollers 43 and 44 of the device of FIG. 4 will pass between rollers 70 and 71 which are driven by chains 72 and 73 respectively. Cylinder 70 is connected to cylinder 44 and cylinder 71 is connected to cylinder 43 of FIG. 4 so that when the speed of cylinders 43 and 44 are adjusted by the differential tachometer 36, the speed of cylinders 70 and 71 will also be adjusted. Film 20 then passes vertically downward between two horizontal blocks 74 and 75 which perform the welding and perforating operations. Block 74 moves vertically in guides 76. Block 74 includes rails 77 which slidably engage vertical grooves in block 76. Guides 76 can also move horizontally in L-shaped blocks 78 which are secured to the frame 79 of the apparatus. When solenoids 83 which are connected to rollers 84 are actuated by a timing device described in FIG. 10, they will propell rollers 84 against block 74 forcing it to engage block 75 so that a pair of toothed surfaces 80 on block 74 will engage toothed surfaces 81 on block 75 to prevent relative motion from occuring between the blocks. Toothed surface 81 preferably has a resilient cushion 82 mounted behind it to absorb the impact shock when the two blocks meet. Simultaneously, solenoids 85 will urge rollers 86 against the back surface of block 75. Cylinders 84 and 86 are driven by chains 72 and 73 connected to their sprocket wheels and coupled to cylinders 70 and 71 respectively. Block 75 includes vertical rails 88 at each end designed to engage and slide into guides 87 which are secured to frame 79 of the apparatus.

Rotating cylinders 84 and 86 pushing against the flat backs of blocks 74 and 75 will create a frictional force which will move both blocks downward in interlocked position and at the same speed as the downward motion of the film so that the welding and perforating operation can take place without interrupting the movement of the film. Block 74 is provided with a resilient pad 89 so that film 20 can be pressed against resilient pad 90 on block 75 located opposite to pad 89. Both pads are sufficiently resilient so that they will compress and cause a perforating blade 91 to project through an opening in pad 90 and through the film into pad 89. Resilient pad 89 is preferably firmer than pad 90 so that pad 90 will compress or deform a greater amount so that the perforating blade can contact and cut through film 20. When blocks 74 and 75 start to disengage, the resilient pad 90 will push the film off the perforating blade 91 so that the film can continue to move freely down.

Disposed below resilient pads 89 and 90 is a teflon impact pad 92 mounted on a resilient pad 93 in block 74. Opposite teflon pad 92 is a teflon coated welding blade 94 which is heated by an electrical heating element (not shown). The tip of the welding blade 94 projects slightly beyond the front surface of block 75 so that it will contact film 20 when the blocks are pushed together. Below welding blade 94 is separating block 95 which projects further into the film than welding blade 94 and is designed to fit below teflon pad 92. Separating block 95 serves to dislodge the film if it sticks to the welding blade after the blocks are separated. Welding blade 94 and perforating blade 91 are preferably designed to be linear but could also be curved such as for the packaging of hams or other meat goods, or could be a zig-zag.

The welding will occur while blocks 74 and 75 are moving downward together with the film. The temperature of welding blade 94 is adjustable and the distance to which the blocks move down together is also adjustable. A microswitch 96 having a pivoted lever arm 97 is designed to interrupt the circuit which energizes solenoids 83 and 85 when block 75 moves sufficiently far to contact arm 97. This will interrupt the power in solenoids 83 and 85 so that internal springs in the solenoids will move cylinders 84 and 86 away from blocks 74 and 75. The blocks will separate due to retraction of block 74 by means of springs 135 and will be returned to their initial positions against stops 99 by means of return springs 98.

Figure 9:
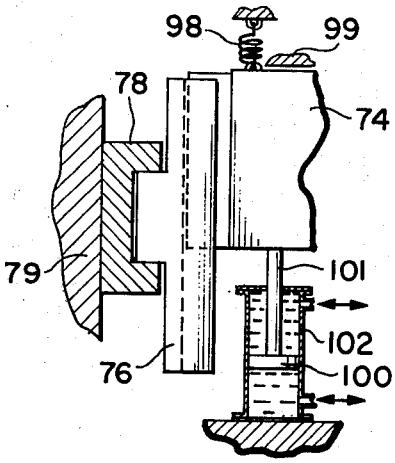
FIG. 9 is a cross sectional view taken through Section 9—9 of FIG. 6.

The weight of each block 74 and 75 is counterbalanced either hydraulically or pneumatically as shown in detail in FIG. 9. A piston 100 connected by means of piston rod 101 to block 74 moves within cylinders 102 so that spring 98 need only be set at minimum tension. Cool air jets 103 are directed along the surface of film 20 as it leaves the perforating and welding device to cool and harden the weld so that the film can move at high speed. Separating bar 95 is designed to disengage the film from welding blade 94 as soon as the blocks separate. The leading edge of bar 95 is inclined downwardly so that the film will slip off this bar more easily during its rapid movement through the perforating and welding device. Bar 95 is made of teflon.

Cylinders 84 and 86 and the backs of blocks 74 and 75 could be metallic with knurled surfaces, serrated, or coated with rubber or other frictional materials so that there will be no slippage between the blocks and the cylinders. Instead of using cylinders 84 and 85, it could also be possible to use a synchromesh pinnion gear and flat synchromesh gear rack fastened vertically to the back of block 75. The pinion gear could be driven at the same speed as the film by chain drive 73 connected to cylinder 71. The rotating pinion would then be pushed against the rack by a solenoid causing the block to move downward. When using the rack and pinion, cylinder 84 would be free to rotate and would not be driven, and would push block 74 against block 75 so that the welding and perforting steps can be completed.

Figure 10:
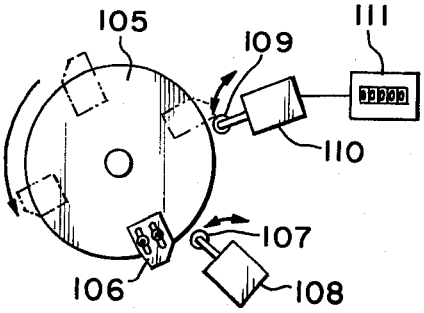
FIG. 10 is a timing device for determining the length of the bags and operating the welding and perforating steps.

Referring to FIG. 10 there is shown a cam disk 105 having at least one cam 106 mounted on its periphery. It is obvious that additional cams as shown in broken line can also be mounted on the disk. The disk is mechanically coupled to the drive system of the welding and perforating apparatus so that it rotates in synchronism with the movement of the film. The diameter of disk 105 is designed to permit the perforating and welding operations for each bag length. Cams 106 are designed to contact the arms 107 and 109 of switches 108 and 110 for each revolution of the cams. Switch 108 is connected to solenoids 83 and 85 so as to actuate the perforating and welding apparatus, or can be connected to solenoids 53 and 61 of the embodiment of FIG. 5. Switch 110 is connected to a counter 111 which can be set to one or any number, so that the output of the counter will produce a signal depending upon the number of revolutions of cam disk 105. Counter 111 is connected to solenoids 115 and 116 of FIG. 13 to separate a predetermined number of bags.

Figure 12:
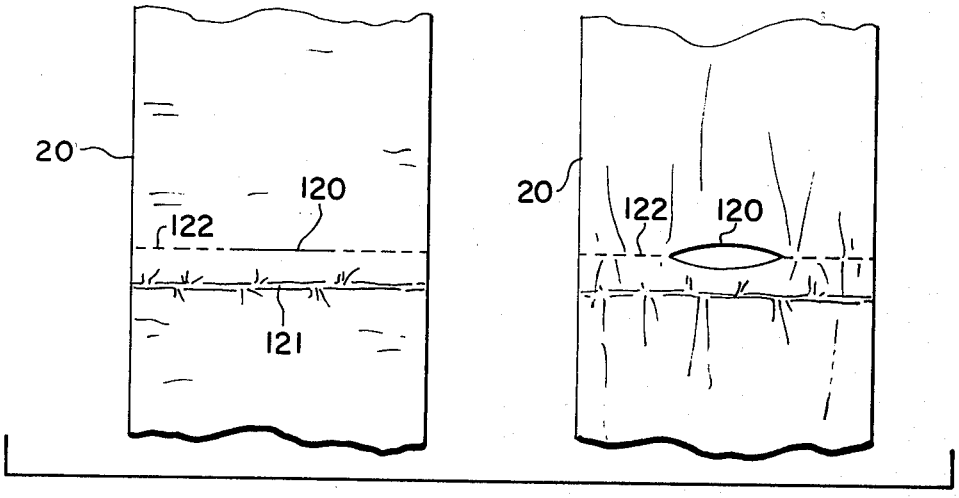
FIG. 12 is a plan view showing the welds and perforations of the plastic web.

As shown in detail in FIG. 12, film 20 has transverse short perforations 122 on each side of a long cut 120 located midway across the film. These perforations and cut penetrate both sides of the film and are adjacent to the weld 121. When the film is stretched on each side of the perforation line, the cut line 120 will open and the perforations 122 on each side of cut 120 will tear to the edges of the film so that the bags can be separated. The apparatus of FIG. 13 will accomplish this operation by providing a pair of feed rollers 117 and 118 which are coupled to the main drive rollers of the perforating and welding apparatus, while solenoid operated rollers 123 and 124 are driven at a speed much greater than the speed of rollers 117 and 118. Thus, when counter 111 produces an output signal to operate solenoids 115 and 116, rollers 123 and 124 are propelled into contact with film 20, which will be stretched so that cut line 120 will open and tear across perforations 122 in order to separate the bags. After cam 106 passes over lever 109, the electrical signals sent by counter 111 to solenoids 115 and 116 are terminated and rollers 123 and 124 are retracted by internal springs of the solenoids. The film will continue to move through the apparatus by the driving motion of rollers 117 and 118. Thus, solenoids 115 and 116 can be operated to sever off each individual bag as the film moves through rollers 117 and 118, or can be operated to sever, for example, every 50th or 100th bag if they are to be coiled on a paper roll and sold in a package. Counter 111 is adjustable so that the film can be separated for any preset number of revolutions of disk 105, and therefore any preset number of bags that are to be collected.

If more cams are mounted on disk 105 and equally spaced, two or more bags can be produced per revolution of disk 105. These bags would be of shorter length than if only one cam was mounted on the disk.

The length of the bags can also be changed by moving the cams radially in or out on disk 105 or increasing or decreasing the diameter of the disk.

If the film is to be printed by the printing apparatus of FIG. 2, a special mark could be printed on a side of the film and used for timing purposes. Instead of using the timing device of FIG. 10, a photocell would be directed onto the edge of the film and used to actuate the welding and perforating solenoids of the apparatus of FIGS. 6–9. For the apparatus of FIG. 5, two photocells would have to be provided so that one could be connected to the welding solenoid and the other to the perforating solenoid. A further photocell connected to a counter switch could be coupled to solenoids 115 and 116 of FIG. 13 in order to separate a pedetermined number of bags from the film. If opaque film is used where photocells may be ineffective, magnetic marks could be printed onto the film and detected by magnetic heads instead of the photocells so that the magnetic heads would perform the same operations as the photocells described above.

Figure 11:
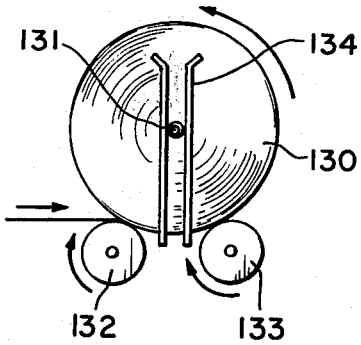
FIG. 11 is a roller for receiving a continuous string of welded and perforated bags.

Referring to FIG. 11 there is shown a roll of blown plastic film 130 which has been both welded and perforated to form a continuous string of bags which have not been separated or pulled apart. The film is wrapped counterclockwise around a tube which has been slipped over a shaft 131. The tube and shaft 131 are supported by rollers 132 and 133 which are driven at the same speed as the film and rotate in a clockwise direction. Rollers 132 and 133 force the coil of film 130 to rotate so that a continuous string of bags can be rolled up onto the tube and taken off for packaging and sale. This apparatus is similar to the apparatus shown in FIG. 3 and includes vertical guides 134 which define vertical grooves to permit shaft 131 to rise up vertically as the diameter of coil 130 increases.

Figure 13:
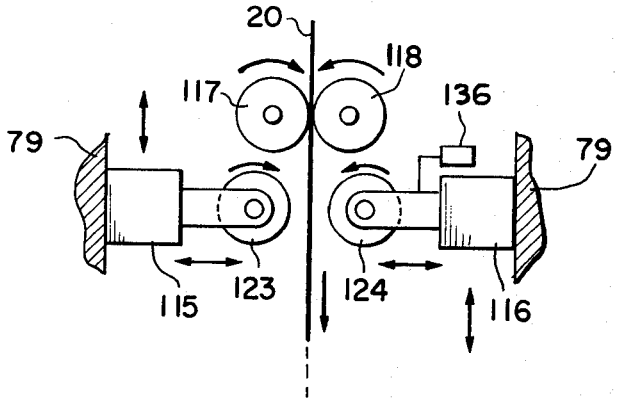
FIG. 13 is a device consisting of differentially moving rollers for separating the bags from the web.

The timing device of FIG. 10 can be adjusted so that just after the film perforation line passes through rollers 117 and 118 of the separating device of FIG. 13, solenoids 115 and 116 can be actuated so that faster moving rollers 123 and 124 can contact the film. Counter 136 of FIG. 13 is attached to the support for roller 124 and counts each time solenoid 116 is actuated. It can be set to stop the machine after a preset number of bags or a preset number of strings of bags have been dropped into a box. The counter 136 could also stop the machine momentarily and acutate a conveyor to move another box into position before the machine is restarted. When the machine is connected to an extruder or printing machine, counter 136 will not stop the machine but will only give a warning signal to the operator to let him know that the preset number of bags or strings have been produced.

While some portions of the apparatus have been shown to be operated in a vertical position, it is obvious that these devices could also operate horizontally without difficulty. The film drive motor (not shown) is mechanically coupled to the film rollers and timing disk of FIGS. 2–11 and 13 and may consist of any variable speed motor capable of speed control by an adjustable tachometer.

Figure 14:
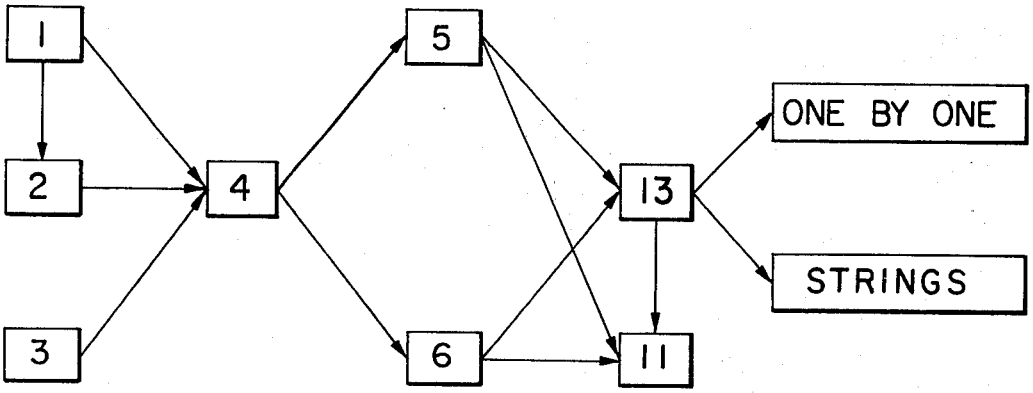
FIG. 14 is an operational block diagram showing the various combinations of units of each of the figures which can be combined to form the preferred embodiment of the invention.

In FIG. 14, a block diagram is shown illustrating the different types of assemblies which can be used to produce the plastic bags. Each of the boxes is labeled with the figure number so that film from the extruder of FIG. 1 can be fed directly into the tensioning device of FIG. 4, or have the film fed into the printing machine of FIG. 2 before entering the apparatus of FIG. 4. Likewise, a roll of film such as that shown in FIG. 3 can also be fed directly into the tensioning device of FIG. 4. From the output of the tensioning device of FIG. 4, the film can be fed into the welding perforating apparatus of FIG. 5 or, into the welding and perforating apparatus of FIGS. 6–9. The outputs of either of the devices of FIGS. 5 or 6 can be fed into the film separating device of FIG. 13 so that either single bags are produced or strings of bags of 50 or 100 are produced. Likewise, the film from either device of FIG. 5 or FIGS. 6–9 can be fed to the roll device of FIG. 11 so that the film can be wound on a tube. Likewise, the output of the separating device of FIG. 13 could also be fed to the roll of FIG. 11.

While only a few embodiments of the present invention have been shown and described, it will be obvious that many changes and modifications may be made thereunto without departing from the spirit and scope of the invention.

I claim:

1. An apparatus for the manufacture of plastic bags from a continuous film of tubular plastic material comprising:

a film drive for advancing the film through the apparatus in a continuous manner;

film speed means coupled to said film drive for detecting the speed of the film in at least two different places and adjusting the speed to remove tension in the film due to shrinkage;

welding and perforating means for engaging the moving film and forming a transverse perforation and weld on the film;

said welding means comprising a first roller for receiving the travelling film;

a welding blade pivotably mounted adjacent to said roller;

a first solenoid connected to said welding blade for advancing said blade into the travelling film against said first roller so that the welding blade will engage the travelling film and travel with the film to complete the weld before returning to its initial position; and timing means coupled to said film drive and connected to said welding and perforating means for operating said welding and perforating means at predetermined intervals of film length.

2. The apparatus as recited in claim 1 wherein said perforating means comprises:

a pivotably mounted perforating blade directed at the film and mounted adjacent to said welding blade;

a solenoid connected to said perforating blade;

a travelling perforating block mounted opposite to said perforating blade wherein the film passes between the blade and the block so that when said solenoid is energized, said blade will engage the film into the perforating block and the perforating block and blade will travel with the film to complete the perforation.

3. The apparatus as recited in claim 7 wherein said film speed means comprises an adjustable differential tachometer connected to said drive means for regulating the speed of the film in said apparatus.

4. The apparatus as recited in claim 1, additionally comprising a storage roller having a central axis;

vertical guide means for receiving said storage roller to permit movement of its axis along said vertical guide; and first and second rollers connected to said film drive for receiving and supporting said film on said storage roller.

5. The apparatus as recited in claim 1 additionally comprising a printing machine surrounding said film for imprinting indicia thereon.

6. The apparatus as recited in claim 1 additionally comprising a film supply roller having a central axis;

vertical guide means for receiving said supply roller to permit movement of its axis along said vertical guide; and first and second rollers connected to said film drive for receiving and supporting said film on said supply roller.

7. An apparatus for the manufacture of plastic bags from a continuous film of tubular plastic material comprising:

a film drive for advancing the film through the apparatus in a continuous manner;

film speed means coupled to said film drive for detecting the speed of the film in at least two different places and adjusting the speed to remove tension in the film due to shrinkage;

welding and perforating means for engaging the moving film and forming a transverse perforation and weld on the film;

said welding and perforating means comprising first and second spaced-apart blocks disposed on each side of said film;

a first drive means engaging said first block for urging said first block into said second block and moving said block at the same speed as the travelling film and in the direction of the film;

second drive means for engaging said second block for moving said second block in the direction of said film;

a perforating blade mounted on said second block and directed at the film and said first block;

a resilient pad mounted on said first block opposite said perforating blade so that the engagement of said first and second blocks causes said perforating blade to cut said film;

a welding blade mounted on said second block and directed at said film and said first block so that when said blocks are urged together, said blocks will travel at the same speed as said film to complete the welding and perforation thereof; and timing means coupled to said film drive and connected to said welding and perforating means for operating said welding and perforating means at predetermined intervals of film length.

8. the apparatus as recited in claim 7 wherein said timing means comprises:

a cam disk having at least one cam disposed on its periphery, said cam disk being coupled to said film drive, and at least one switch having a contact arm for engagement with said cam, said switch being electrically connected to said first and second drive means.

9. The apparatus as recited in claim 8 additionally comprises a second switch mounted adjacent to said cam disk for engagement with said cam, and an adjustable counter connected to said second switch for producing a signal after a predetermined number of revolutions of said disk.

10. The apparatus as recited in claim 9 wherein said perforating means comprises a perforating blade for forming a transverse cut along a portion of said film and a plurality of perforations adjacent to said cut on both sides thereof.

11. The apparatus as recited in claim 7 wherein said first and second blocks additionally comprise interlock means disposed between said blocks for perventing relative movement between the blocks during their engagement.

12. The apparatus as recited in claim 7 wherein said first drive means comprises a pair of rollers having their periphery driven at the speed of the film, and solenoids connected to each of said rollers for urging said rollers against said first block into engagement with the travelling film.

13. The apparatus as recited in claim 7 wherein said second drive means comprises a second pair of rollers having their peripheral surfaces driven at the speed of the film and solenoids for urging said second pair of rollers into engagement with said second block simultaneously with the engagement of said first rollers to said first block.

14. The apparatus as recited in claim 10 comprising a first pair of separating rollers coupled to said film drive and having said film disposed therebetween;

a second pair of separating rollers mounted adjacent to said first pair of separating rollers and spaced apart from said film; and a pair of solenoids connected to each of said second pair of rollers, said solenoids being connected to the output of said adjustable counter and further drive means for driving said second pair of rollers at a speed greater than said first pair of separating rollers, so that when said adjustable counter produces an output signal to energize the solenoids and urge said second pair of separating rollers against said film, said film will be torn at its perforation line and separated, and a bag output counter coupled to one of said solenoids for signalling or stopping the film drive after a predetermined number of bags have been produced.

15. The apparatus as recited in claim 7 wherein at least one of said blocks comprises damping means for dampening the motion of movement of said block during its travel with the film.

16. The apparatus as recited in claim 7 wherein said first and second blocks include vertical guides for permitting sliding movement of said block in the direction of motion of said film, and at least one switch mounted in said vertical guides near the end of the travel of said blocks thereof so that when said block engages said switch, said first and second drive means will be interrupted so that said blocks will be returned to their initial position.

* * * * *